US005435081A

United States Patent [19]

Hannes

[11] Patent Number: 5,435,081

[45] Date of Patent: Jul. 25, 1995

[54] BALLAST PLOW

[75] Inventor: Felber Hannes, Salzburg, Austria

[73] Assignee: Franz Plasser Bahnbaumaschinen-Industriegesellschaft, Vienna, Austria

[21] Appl. No.: 63,454

[22] Filed: May 18, 1993

[30] Foreign Application Priority Data

May 25, 1992 [AT] Austria ..... 1084/92

[51] Int. Cl.[6] ..... E02F 5/22

[52] U.S. Cl. ..... 37/106; 171/16

[58] Field of Search ..... 37/104, 105, 106; 171/16; 104/10, 12

[56] References Cited

U.S. PATENT DOCUMENTS

| | | | |
|---|---|---|---|
| 971,460 | 9/1910 | Meland et al. | 37/105 |
| 1,167,900 | 1/1916 | Jacobsen | 37/105 |
| 3,019,536 | 2/1962 | Kershaw | 37/104 |
| 3,706,145 | 12/1972 | Bucksch et al. | 37/105 |
| 4,196,532 | 4/1980 | Muller | 37/105 |
| 4,266,352 | 5/1981 | Newman | 37/105 |
| 4,464,995 | 8/1984 | Nameny . | |
| 4,706,395 | 11/1987 | Cicin-Sain | 171/16 X |
| 4,707,935 | 11/1987 | Cicin-Sain | 37/105 |
| 4,951,573 | 8/1990 | Madison | 37/105 X |
| 5,094,018 | 3/1992 | Theurer et al. | 171/16 X |
| 5,097,608 | 3/1992 | Theurer . | |

FOREIGN PATENT DOCUMENTS 1590269 5/1981 United Kingdom .

*Primary Examiner*—Dennis L. Taylor
*Assistant Examiner*—V. Batson
*Attorney, Agent, or Firm*—Meltzer, Lippe, Goldstein, Wolf, Schlissel & Sazer

[57] ABSTRACT

A ballast plow (1) comprises a machine frame (6) supported on on-track undercarriages (2), with which is associated a center plow (5) which is vertically adjustable by means of drives and on each longitudinal side of the machine a vertically adjustable shoulder plow (8) having a plow blade (20) which may be brought into contact with ballast. The shoulder plow is provided with an articulation point (13) and a telescopically extendable carrier frame (12) extending perpendicularly to the longitudinal direction of the machine. The articulation point (13) is situated in each case—viewed in the transverse direction of the machine—on the longitudinal side of the machine which is further away from the associated plow blade (20) of the shoulder plow (8). The plow blade (20) is mounted for pivoting about an axis (21) extending in the longitudinal direction of the machine and is connected to a shoulder angle adjustment drive (15).

6 Claims, 2 Drawing Sheets

BALLAST PLOW

BACKGROUND OF THE INVENTION

The invention relates to a ballast plow machine comprising a machine frame supported on on-track undercarriages having a center plow. The center plow is vertically adjustable by means of drives. The machine frame also has on its longitudinal side, a plow blade which may be brought into contact with the ballast and with an articulation point. The inventive ballast plow also comprises a telescopically extendable carrier frame which extends perpendicular to the longitudinal direction of the machine.

A ballast plow comprising a machine frame supported on on-track undercarriages is known through U.S. Pat. No. 5,097,608. Between the on-track undercarriages this has a vertically adjustable center plow and shoulder plows positioned in front of the center plow. Each shoulder plow is joined to the machine frame by means of a lateral articulation point arranged on the machine frame and having an axis extending in the longitudinal direction of the machine, and has a carrier frame which may be extended telescopically in the transverse direction of the machine by means of a drive.

The object of the present invention lies in creating a ballast plow of the type described in the introduction, the shoulder plows of which may also be used for treating the track bench region adjacent to the base of the crown of the ballast bed.

SUMMARY OF THE INVENTION

This object is achieved with a ballast plow of the type described in the introduction in that the articulation point—viewed in the transverse direction of the machine—is in each case arranged on the longitudinal side of the machine which is further away from the associated plow blade of the shoulder plow, and the plow blade is mounted for pivoting about an axis extending in the longitudinal direction of the machine and is connected to a shoulder angle adjustment drive.

As a result of this combination of features, it is possible both to extend the carrier frame and thus the operating range and also to effect a rapid change to the shoulder angle, so that in addition to the ballast shoulder, the track bench region, which in most cases forms a horizontal surface, can also be treated without difficulty. The specific articulated attachment of the carrier frame to the machine frame further ensures the very advantageous arrangement of the carrier frame beneath the machine frame for the purpose of transfer travel. This neither affects the view from the driver's cab onto the track nor is there any adverse effect on the situation in which the two shoulder plows are in an inoperative position while the center plow is being used on its own.

The two-fold pivotable mounting of the plow blade according to a further development makes a relatively large pivoting angle possible, with the result that the treatment of a track bench adjacent to the outer rail of a superelevated section is also unrestrictedly possible.

A further development enables the carrier frame to be designed in a particularly advantageous manner to produce the widest possible adjustment range of the shoulder plow, but without the clearance gauge being exceeded for the transfer of the ballast plow.

The invention is described in more detail below with the aid of an embodiment.

DETAILED DESCRIPTION OF THE INVENTION

Figure 1:
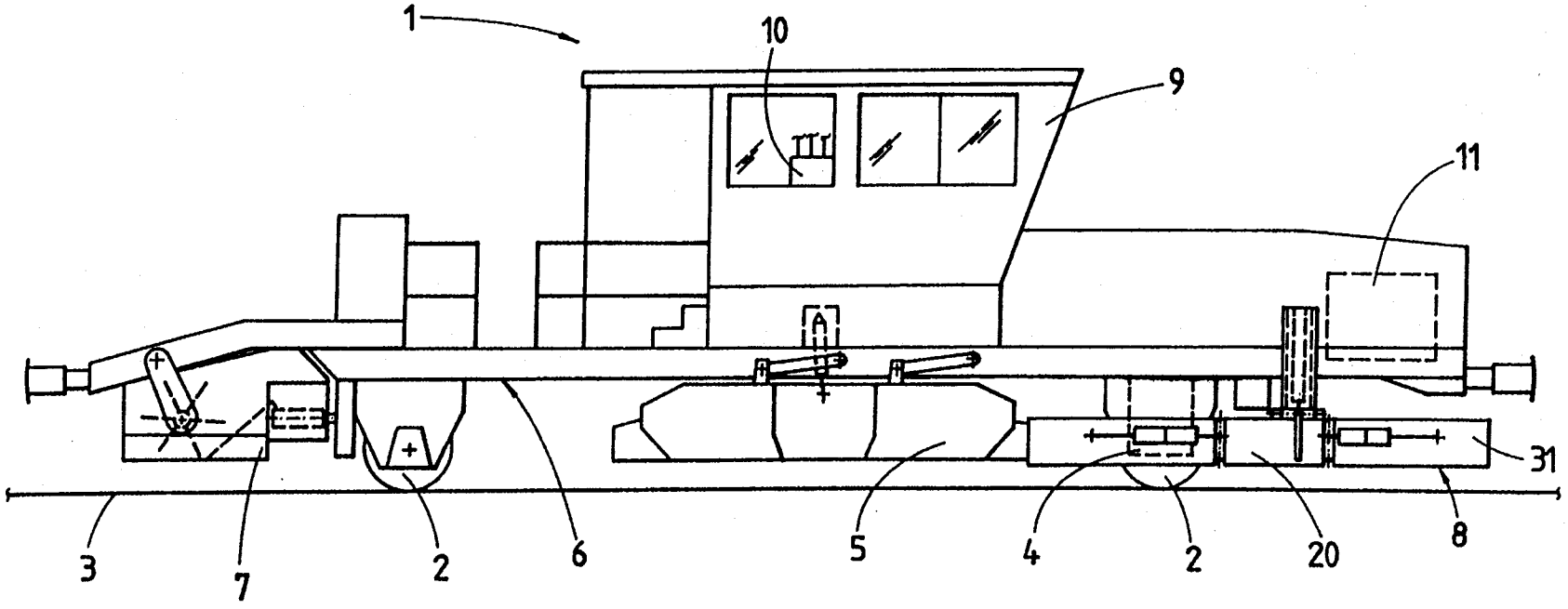
FIG. 1 shows a schematically simplified side view of a ballast plow with a center- and two shoulder plows.

The ballast plow 1 evident in FIG. 1 is mobile by means of on-track undercarriages 2 on a track 3 composed of sleepers and rails with the aid of a motive drive 4. Between the two on-track undercarriages 2, a center plow 5 is vertically adjustably connected to a machine frame 6. Located in a section of the machine frame 6 which is bent upwards at a right angle is a vertically adjustable sweeping device 7 with a lateral conveyor belt for transporting surplus ballast away. Arranged in the opposite end region of the machine frame 6 to the sweeping device 7 are two shoulder plows 8 which will be described in greater detail below with reference to FIG. 2 and 3. A driver's cab 9 with a central control means 10 and also a central power plant 11 are situated on the machine frame 6.

Figure 3:
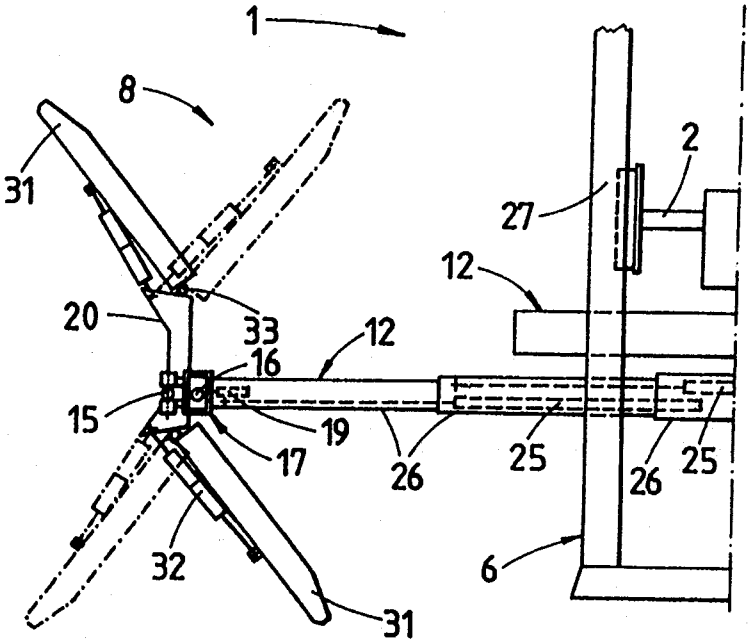
FIG. 3 shows a partly schematically represented plan view of the shoulder plow as shown in FIG. 2.
Figure 2:
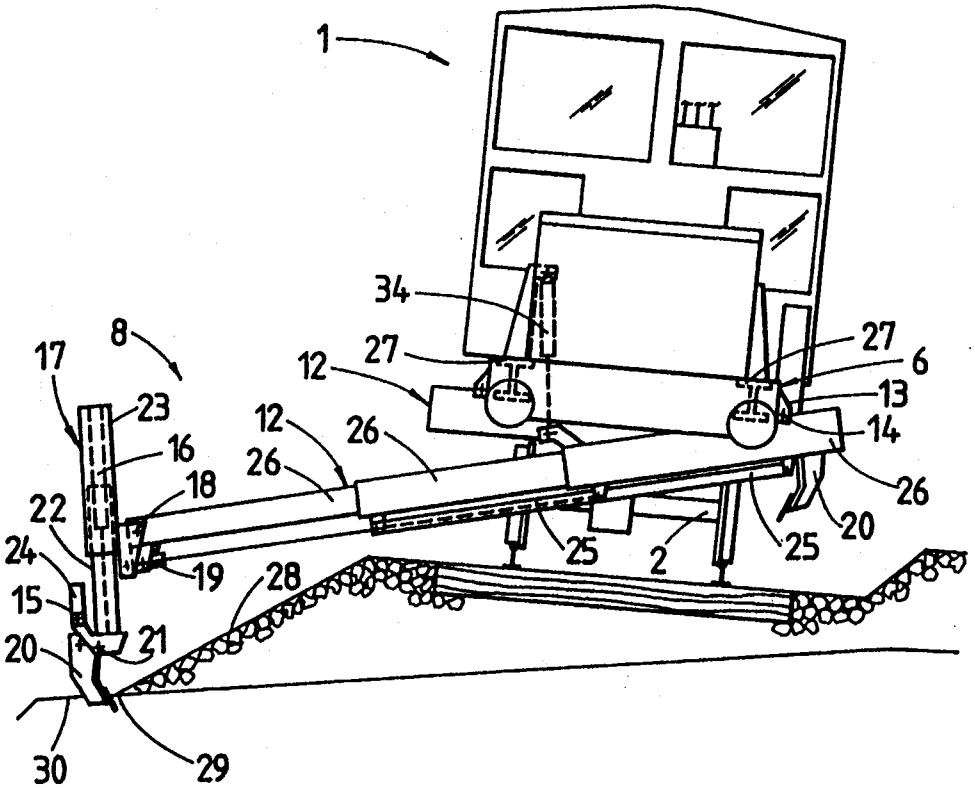
FIG. 2 shows a view of the machine in the longitudinal direction of the machine, a shoulder plow being extended for the treatment of a track bench.

The shoulder plow 8 evident in FIG. 2 and 3 is secured on a carrier frame 12 extending perpendicularly to the longitudinal direction of the machine and designed so as to be telescopic. The said carrier frame is in turn secured for pivoting about an axis 14 extending in the longitudinal direction of the machine, forming an articulation point 13, on the longitudinal machine side of the machine frame 6 which is further away from the shoulder plow 8 in the transverse direction of the machine.

The plow blade 20 is mounted together with a shoulder angle adjustment drive 15 and a vertical adjustment drive 16 on a carrier body 17 which is itself mounted on the telescopic carrier frame 12 for pivoting about a pivot axis 18 extending in the longitudinal direction of the machine and is connected to a pivot drive 19. The plow blade 20 of the shoulder plow 8, which extends in the longitudinal direction of the machine, is secured to the lower end of an inner telescopic tube 22 of the carrier body 17. The plow blade 20 is pivoted about an axis 21 which extends in the longitudinal direction of the machine. The inner telescopic tube 22 is mounted in an outer telescopic tube 23 for displacement in the longitudinal direction thereof. The outer telescopic tube 23 is pivoted about a pivot axis 18. A shoulder angle adjustment cylinder 24 is provided for adjusting the plow blade 20 about the axis 21.

Two drives 25 are provided for the transverse adjustment of the carrier frame 12 with respect to the longitudinal direction of the machine. The carrier frame 12 is composed of three parts 26 which are telescopically displaceable into one another in order to adjust the length of the carrier frame 12 in a transverse direction relative to the longitudinal direction of the machine. The part 26 furthest away from the plow blade 20 is connected to the articulation point 13 and to a drive 34 in order to provide for a vertical adjustment. Between two longitudinal supports 27 of the machine frame 6, which are spaced apart from one another in the transverse direction of the machine, the drive 34 is secured on the longitudinal support 27 which is furthest away from the articulation point 13.

In the operating position represented in FIG. 2, the plow blade 20 is already positioned on a track bench region 30 adjoining a crown base 29 of a ballast bed shoulder 28. (The feed plow blades are not represented in FIG. 2 for reasons of greater clarity). The distance between the articulation point 13 of the carrier frame 12 and the end of the carrier frame part 26 on the plow side and connected to the drive 34 is smaller than or equal to the distance between the two longitudinal supports 27.

Located immediately behind the shoulder plow 8 represented in operational use, viewed in the longitudinal direction of the machine, is a further shoulder plow 8 in a transfer position.

As is evident in FIG. 3, respective feed plow blades 31 are joined both to the front and to the rear end of the plow blade 20. Each feed plow blade 31 is pivoted for movement about an axis 33 which extends perpendicularly to the lower edge of the plow blades 20. Each feed plow blade 31 is moved about the axis 33 by means of a drive 32. The drives 32 move the feed plow blades 31 thus changing the angle of the feed plow blades 31 (see representation in solid and in dot and dash lines). By swivelling the feed plow blades 31 correspondingly, it is possible to use the shoulder plow 8 in both directions of travel of the ballast plow 1.

While the invention has been described by reference to specific embodiments, this was for purposes of illustration only. Numerous alternative embodiments will be apparent to those skilled in the art and are considered to be within the scope of the invention.

I claim:

1. A ballast plow machine for railway track maintenance comprising:

a machine frame supported on on-track undercarriages, a vertically adjustable center plow attached to said machine frame, a vertically adjustable shoulder plow attached to each longitudinal side of said machine, each shoulder plow including a telescopically extendible carrier frame extending perpendicularly to the longitudinal direction of said machine, a plow blade which may be brought into contact with ballast, and an articulation point by means of which said carrier frame is attached to said machine frame, said articulation point, when viewed in a transverse direction of said machine, being located on the longitudinal side of said machine which is further away from the plow blade associated with said shoulder plow, and a shoulder angle adjustment drive associated with each plow blade for pivoting said associated plow blade about an axis which extends in the longitudinal direction of said machine.

2. The ballast plow of claim 1 further comprising a carrier body bearing said plow blade of said shoulder plow and a vertical adjustment drive mounted on said telescopic carrier frame along with said shoulder angle adjustment drive, and a pivot drive connected to said carrier body for pivoting said carrier body about a pivot axis extending in the longitudinal direction of said machine.

3. The ballast plow of claim 2 wherein said carrier body comprises inner and outer telescopic tubes, said outer telescopic tube being displaceable in a longitudinal direction thereof, said plow blade and said shoulder angle adjustment drive being secured to a lower end of said inner telescopic tube.

4. The ballast plow of claim 1 wherein an end of said carrier frame lying opposite said plow blade with which it is associated extends beyond a cross-sectional outline of said machine.

5. The ballast plow of claim 1 further comprising two longitudinal supports spaced apart from one another in a transverse direction of said machine, and a vertical adjustment drive for said shoulder plow secured between said longitudinal supports and on the longitudinal support which is further away from said articulation point.

6. The ballast plow of claim 5 wherein said carrier frame comprises three parts, one of said parts being connected to said articulation point and having an end spaced therefrom in transverse direction and facing the shoulder plow, wherein the distance between said end and said articulation point is smaller or equal to the distance between the two longitudinal supports.

* * * * *